US008959947B2

(12) United States Patent
Zhai et al.

(10) Patent No.: US 8,959,947 B2
(45) Date of Patent: Feb. 24, 2015

(54) OIL BALANCE DEVICE, A COMPRESSOR UNIT AND A METHOD FOR PERFORMING AN OIL BALANCE OPERATION BETWEEN A PLURALITY OF COMPRESSOR UNITS

(75) Inventors: Stone Zhai, Jiangsu (CN); Xiucheng Ji, Jiangsu (CN); Zhonghua Gu, Jiangsu (CN)

(73) Assignees: Johnson Controls Technology Company, Holland, MI (US); Johnson Controls Building Efficiency Technology (WUXI) Company, Jiangsu (CN)

( * ) Notice: Subject to any disclaimer, the term of this patent is extended or adjusted under 35 U.S.C. 154(b) by 416 days.

(21) Appl. No.: 13/050,116

(22) Filed: Mar. 17, 2011

(65) Prior Publication Data

US 2011/0162746 A1 Jul. 7, 2011

Related U.S. Application Data

(63) Continuation-in-part of application No. PCT/CN2009/001040, filed on Sep. 17, 2009.

(30) Foreign Application Priority Data

Sep. 19, 2008 (CN) ..... 2008 1 161327

(51) Int. Cl.
*F04B 39/02* (2006.01)
*F25B 31/02* (2006.01)
(Continued)

(52) U.S. Cl.
CPC ..... *F25B 31/004* (2013.01); *F25B 13/00* (2013.01); *F25B 2313/0233* (2013.01); *F25B 2313/0253* (2013.01); *F25B 2400/075* (2013.01); *Y10S 417/902* (2013.01)
USPC ..... 62/469; 62/193; 417/228; 417/902

(58) Field of Classification Search
CPC .... F04B 39/02; F04B 39/0207; F25B 31/002; F25B 31/004; F25B 2400/06; F25B 2400/075
USPC ..... 417/53, 228, 902; 62/193, 469, 510
See application file for complete search history.

(56) References Cited

U.S. PATENT DOCUMENTS 3,500,962 A * 3/1970 Kocher ..... 184/103.1
3,719,507 A * 3/1973 Bardeau ..... 99/375
(Continued)

FOREIGN PATENT DOCUMENTS

CN 2670861 Y 1/2005
CN 1707201 A 12/2005
(Continued)

*Primary Examiner* — Peter J Bertheaud
(74) *Attorney, Agent, or Firm* — McNees Wallace & Nurick LLC

(57) ABSTRACT

The present invention disclosures an oil balance device and a method for performing an oil balance operation between a plurality of compressor units, which are suitable for air conditioner units comprising at least two parallel connected compressor units. Each compressor unit comprises at least one parallel connected compressors. The oil balance device comprises an oil reservoir, a first pipe, a second pipe, a third pipe and a fourth pipe. The four pipes communicate with the oil reservoir respectively. Each pipe is provided with at least one valve to control the opening and the closing of the corresponding pipe. The first valve and the fourth valve are closed and the second valve and the third valve are opened if the compressor unit is in normal operation; the first valve and the fourth valve are opened and the second valve and the third valve are closed if the compressor unit supplies oil; the second valve and the fourth valve are opened and the first valve and the third valve are closed, or the third valve and the fourth valve are opened and the first valve and the second valve are closed, if the compressor unit receives oil.

26 Claims, 8 Drawing Sheets

(51) Int. Cl.
*F25B 31/00* (2006.01)
*F25B 13/00* (2006.01)

(56) References Cited

U.S. PATENT DOCUMENTS 4,478,050 A * 10/1984 DiCarlo et al. ..... 62/193
4,895,498 A * 1/1990 Basseggio ..... 417/426
5,112,201 A * 5/1992 Tamura et al. ..... 417/366
5,150,586 A * 9/1992 Basseggio ..... 62/468
6,446,462 B1 * 9/2002 Kiyokawa et al. ..... 62/469
6,604,371 B2 * 8/2003 Ueno ..... 62/193
7,585,160 B2 * 9/2009 Hirooka et al. ..... 417/410.5
8,075,283 B2 * 12/2011 Shaw ..... 417/228
8,327,661 B2 * 12/2012 Fujimoto et al. ..... 62/510
8,408,024 B2 * 4/2013 Ogata et al. ..... 62/402
2006/0101845 A1 5/2006 Jeong et al.

FOREIGN PATENT DOCUMENTS

CN 101093121 A 12/2007
JP 2001201200 A 7/2001

* cited by examiner

OIL BALANCE DEVICE, A COMPRESSOR UNIT AND A METHOD FOR PERFORMING AN OIL BALANCE OPERATION BETWEEN A PLURALITY OF COMPRESSOR UNITS

CROSS REFERENCES TO RELATED APPLICATIONS

This application is a continuation of International Application No. PCT/CN2009/001040, entitled "OIL EQUALIZING DEVICE, COMPRESSOR UNIT AND OIL EQUALIZING METHOD," filed on Sep. 17, 2009, which claims priority from and the benefit of China Patent Application No. 200810161327.1, entitled "OIL EQUALIZING DEVICE, COMPRESSOR UNIT AND OIL EQUALIZING METHOD," filed Sep. 19, 2008, both of which applications are hereby incorporated by reference in their entirety.

FIELD OF THE INVENTION

The invention relates to an oil balance device and a compressor unit, which are used in multi-air conditioners, water-cooled or air-cooled duct type air conditioners, a scroll-type water-cooled or air-cooled chiller or heat pump, water-cooled package unit and other types of refrigeration units, and a method for performing an oil balance operation between the compressor units.

BACKGROUND OF THE INVENTION

Generally, variable volume refrigeration units, in which a plurality of outdoor units are connected in parallel, comprises a plurality of oil balance devices connected in parallel to the compressor units.

CN Pat. No. 1707201A discloses a method for performing an oil balance operation by utilizing the compressor discharge pressure to provide the power. The lubricating oil runs subsequently to different compressors belonging to different units but the flow of lubricating oil depends on the start and stop operations of other compressors to provide a pressure difference. The cycling on and off disadvantageously influences the normal cooling and heating operation of the refrigeration units and increases the start and stop cycling of the compressors to shorten their service life. Furthermore, the balancing of the lubricating oil is driven by the power provided by the other running compressors and the balancing will have problems if one of the other compressors fails, especially when installation height gaps exist between the units.

Furthermore, in other oil balancing schemes, a complex system of pipes is required to be installed inside and outside the outdoor units and the inclination angle of the pipes are strictly limited. These restrictions lead to a high cost for the installation and the manufacture of such devices.

SUMMARY OF THE INVENTION

An object of the present invention is to provide an oil balance device and a compressor unit using the oil balance device and a method for performing the oil balance operation between the compressor units to realize a reliable oil supply to each compressor unit and the compressor or compressors therein.

To realize the invention, the present invention provides an oil balance device comprising an oil reservoir, a first pipe, a second pipe, a third pipe and a fourth pipe. The four pipes communicate with the oil reservoir respectively. Each pipe is provided with at least one valve to control the opening and the closing of the corresponding pipe.

The present invention also provides a compressor unit comprising at least a compressor and at least an oil balance device. The oil balance device comprises:

- an oil reservoir;
- a first pipe, wherein one end of the first pipe communicates with the oil reservoir and the other end communicates with the discharge pipe of the compressor;
- a first valve for controlling the flow on/off of the first pipe;
- a second pipe, wherein one end of the second pipe communicates with the oil reservoir and the other end communicates with the gas balance opening of the compressor;
- a second valve for controlling the flow on/flow off of the second pipe;
- a third pipe, wherein one end of the third pipe communicates with the oil reservoir and the other end communicates with the oil balance opening of the compressor;
- a third valve for controlling the flow on/flow off of the third pipe;
- a fourth pipe, wherein one end of the fourth pipe communicates with the oil reservoir and the other end communicates with another oil reservoir belonging to an adjacent compressor unit;
- a fourth valve for controlling the flow on/flow off of the fourth pipe.

Preferably, the end communicating with the bottom of the oil reservoir of the fourth pipe inserts into the interior of the oil reservoir for a certain height to make sure enough oil would be retained in the compressor unit for its own use when the unit supplies oil to other units.

Preferably, the second valve comprises a valve plate and a magnet below the valve plate and an aperture formed on the valve plate. The size of the aperture makes no difference to the closing of the second valve and pressure difference between the two sides of the valve plates is removed when the second valve is switched from the off status to the on status.

The present invention provides a method for performing an oil balance operation between a plurality of compressor units. The method comprises the following steps:

providing an oil reservoir for each compressor unit;

providing a first pipe, a second pipe, a third pipe and a fourth pipe for each compressor unit;

connecting the first pipe to the oil reservoir of one compressor unit and to the discharge pipe of the compressor;

connecting the second pipe to the oil reservoir of the compressor unit and to the gas balance opening of the compressor;

connecting the third pipe to the oil reservoir of the compressor unit and to the oil balance opening of the compressor;

connecting the fourth pipe to the oil reservoir of the compressor unit and to another oil reservoir belonging to an adjacent compressor unit;

controlling the flow on/flow off status of the first pipe, the second pipe, the third pipe and the fourth pipe by the first valve, the second valve, the third valve and the fourth valve respectively;

closing the first valve and the fourth valve and opening the second valve and the third valve for the plurality of compressor units in normal operation;

opening the first valve and the fourth valve and closing the second valve and the third valve for the compressor units supplying oil;

opening the second valve and the fourth valve and closing the first valve and the third valve, or opening the third valve and the fourth valve and closing the first valve and the second valve, for the compressor units receiving oil.

According to the present invention, excess oil is discharged to an adjacent unit and simultaneously sufficient oil is retained for the use of the supplying unit. Therefore, the oil balance can be achieved without the use of special oil level detecting instruments if the oil cycling between the different oil reservoirs is carried out regularly. In addition, oil cycling between the different units is driven by the discharge pressure of the compressors so that a certain amount of installation height differences is permitted between units.

This invention does not require forcibly controlling the compressors to start and stop, and will not adversely affect the normal operation of the air conditioner; decreases the loss of compressors; and does not need to consider the height difference between the different units when installing.

BRIEF DESCRIPTION OF THE DRAWINGS

The present invention will be described further with details, based on the combination of the preferred embodiment of the invention and the accompanying drawings, wherein.

DETAILED DESCRIPTION OF THE PREFERRED EMBODIMENT

Figure 1:
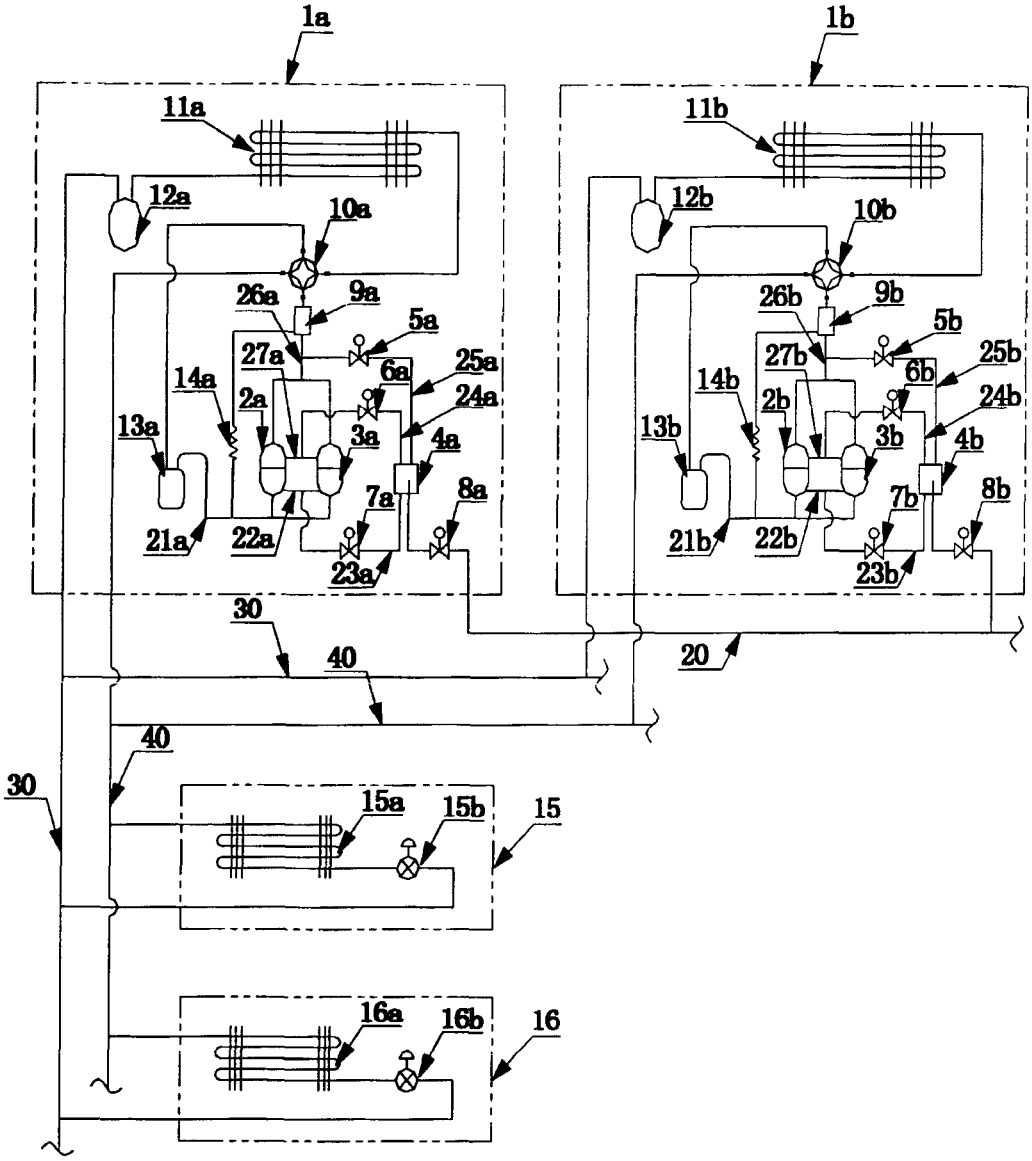
FIG. 1 is a circuit diagram illustrating the configuration of multi-air conditioner units according to a first embodiment of the present invention.

An air conditioning system according to the present invention comprises a plurality of parallel connected compressor units. Each compressor unit comprises one or more parallel connected compressors. The oil balance between the different compressor units is achieved by oil balance devices and corresponding oil balance operations.

The one or more compressor units could be disposed in one or more refrigerating apparatuses, for example, multi-air conditioners, water-cooled or air-cooled duct type air conditioners, scroll-type water-cooled or air-cooled chillers or heat pumps, water-cooled package units and so on. Of course, the application of the present invention should not be limited in the units described above.

A multi-air conditioner system may be taken as an example of the present invention. Each outdoor unit includes a compressor unit and the outdoor units are connected by some gas pipes, liquid pipes, and oil balance pipes. Furthermore, the outdoor units are connected to a plurality of indoor units by some gas pipes and liquid pipes to form an air conditioning system.

In this system each compressor unit comprises one or more than one parallel-connected compressor. The suction pipes and the discharge pipes of the compressors are connected in parallel by some parallel-connected pipes. The parallel-connected compressors are interconnected by an oil balance pipe and a gas balance pipe.

Each compressor unit comprises an oil reservoir and the oil reservoir constitutes an oil balance device with corresponding pipes and control valves. The oil balance device is connected to the compressors in parallel to achieve not only the oil balance between the compressors and the oil reservoir, but also the balance between the oil reservoirs belonging to different compressor units.

The oil balance device according to the prevent invention comprises one oil reservoir and the oil reservoir is connected to the discharge pipe of the compressors through a first connecting pipe and a first control valve. The objective of the connection is that the discharge pressure of the compressors can be used as a power source to force excess oil in the oil reservoir into other units.

The oil reservoir is connected to the gas balance pipe disposed between the compressors through a second connecting pipe and a second control valve. In addition, the oil reservoir is connected to the oil balance pipe through a third connecting pipe and a third control valve. The objective of these connections is that interconnections are created between the oil cavity of the compressors and the oil reservoir. Therefore, the oil level in the compressors and the oil level in the oil reservoir will keep balancing. In other words, the oil quantity in the oil reservoir reflects the oil quantity in the compressors. In normal operation, the oil will automatically flow into the oil reservoir when the oil in the compressors is excessive and the oil will automatically be supplied to the compressors from the oil reservoir when the oil in the compressors is deficient.

The oil reservoir is connected to other oil reservoirs belonging to other units through a fourth connecting pipe and a fourth control valve. The opening and closing of the oil balance pipe between the units can be achieved by the opening and closing of the fourth control valve to control the oil balance between the units.

The first connecting pipe and the second connecting pipe also can be first combined and then connected to the oil reservoir.

The fourth connecting pipe may be inserted into the oil reservoir to a suitable protruding height. The protruding height depends on the size of the oil reservoir and the size of the compressors connecting to the oil reservoir. The objective of setting the protruding height is that enough oil will be retained in the oil reservoir when the oil in the oil reservoir is partially transferred into another unit. The oil will be added to the compressors when the oil level in the compressors is too low such that the reliability of the compressors is improved.

The oil balance between the conditioner units is achieved by the controlling of related valves in the following manner.

Firstly, the oil balance between the compressors belonging to one compressor unit and the balance between the compressors and the oil reservoir in that unit will be performed. Due to the principle of connected vessels, in the interior of each unit the oil level of all the compressors and the oil level of the oil reservoir will balance continuously. The oil will flow into the oil reservoir through the connecting pipe if the oil level in the compressors is too high and the oil in the oil reservoir will automatically supply excess oil to the compressors if the oil level in the compressors is too low. But the oil in the compressors will not flow out through an oil balance aperture once the oil level in the compressors is lower than the oil balance aperture. The height of the bottom of the oil reservoir is the same as that of an oil balance opening of the compressors, or the former is slightly higher, to ensure that the excess oil in the compressor will flow into the oil reservoir.

The oil balance between the compressor units is driven by the power provided by the discharge pressure of the unit supplying the oil. Because the oil reservoir of the compressor unit receiving the oil is in communication with the gas balance pipe of the compressors, the excess oil (the oil above the protruding height) will flow from the unit supplying the oil into the oil reservoir of the unit receiving the oil when the pressure in the oil reservoir of the compressor unit supplying the oil is increased. Each compressor unit will supply oil and the receive oil one by one in a certain order to carry out the oil cycling in such a way that the oil balance between the oil reservoirs belonging to the different compressor units is achieved. In addition, the valve connecting the oil reservoir and the oil balance pipe of the compressors and the valve connecting the oil reservoir and the gas balance pipe of the compressors can be opened to achieve the oil balance between the oil reservoir and the compressors.

The present invention will be described further with details as follows.

With reference to FIG. 1, a multi-air conditioner unit system comprises a plurality of the same or different compressor units connected in parallel. A compressor unit 1*a* and a compressor unit 1*b* are connected in parallel. A section of an oil balance pipe 20 between two junction valves 8*a*, 8*b* connects the compressor units 1*a*, 1*b*. A liquid connecting pipe 30 and a gas connecting pipe 40 connect the compressor units 1*a*, 1*b* in parallel and also connect two indoor units 15, 16 in parallel. The number of the parallel-connected indoor units depends on the air conditioning load.

The indoor unit 15 includes an indoor heat exchanger 15*a* and an expansion valve 15*b*. The indoor unit 16 includes an indoor heat exchanger 16*a* and an expansion valve 16*b*. Each indoor unit 15, 16 is connected to the liquid pipes and the gas pipes disposed between the indoor units 15, 16 and the outdoor units 1*a*, 1*b*.

Because each compressor unit has the same structure, in the following the compressor unit 1*a* is described as an example. The reference number of each component of the compressor unit 1*a* corresponds with that of the compressor unit 1*b*, and the suffixes correspond with compressor units a and b respectively.

As shown in FIG. 1, the compressor unit 1*a* includes two compressors 2*a*, 3*a* (the number of the compressors may be one or more than one in the practical application). The discharge pipes of the two compressors 2*a*, 3*a* are connected in parallel at the point 26*a* and then the point 26*a* is connected to an oil separator 9*a*. The exhaust port of the oil separator 9*a* is connected to a four-way valve 10*a*. The lubricating oil flows though a capillary tube 14*a* and back to a suction pipe 21*a* and then enters into the compressors. The other three interfaces of the four-way valve 10*a* are connected to a condenser 11*a*, a gas-liquid separator 13*a* and the gas connecting pipe 40 respectively. The condenser 11*a* is connected to a liquid reservoir 12*a* (the liquid reservoir 12*a* may be omitted sometimes based on the design of the system) and subsequently is connected to an indoor unit through the liquid connecting pipe 30.

The inlet of the gas-liquid separator 13*a* is connected to the four-way valve 10*a* and the outlet is connected to the suction pipe 21*a*. The refrigerant is divided in the suction pipe 21*a* and is drawn into the compressors 2*a*, 3*a* respectively.

The top of an oil reservoir 4*a* is connected to the compressor discharge pipe 26*a* through a first valve 5*a* so that the high pressure gas in the compressor can be introduced into the oil reservoir 4*a* to provide a pressure for the balancing of the lubricating oil in different units. A gas balance pipe 27*a* is disposed between the paralleled connected compressors 2*a*, 3*a* and the top of the oil reservoir 4*a* is connected to the gas balance pipe 27*a* through a second valve 6*a* so that the balance of gas pressure between the oil reservoir 4*a* and the compressors 2*a*, 3*a* can be maintained.

An oil balance pipe 22*a* is disposed between the compressors 2*a*, 3*a*. The oil reservoir 4*a* is connected to the oil balance pipe 22*a* through another oil balance pipe 23*a* and a third valve 7*a*. The connections between the gas balance pipe 24*a*, the oil balance pipe 23*a* and the compressors 2*a*, 3*a* can achieve not only the oil balance between the parallel connected compressors 2*a*, 3*a*, but also the oil balance between the compressors 2*a*, 3*a* and the oil reservoir 4*a*. Furthermore, based on the principle of connected vessels, the oil level in the oil reservoir 4*a* and the oil level in the compressors 2*a*, 3*a* will equalize. When the oil level in the compressors 2*a*, 3*a* is too high, the oil will flow into the oil reservoir 4*a* through the oil balance pipe 23*a*. When the oil level in the compressors 2*a*, 3*a* is too low, the oil in the oil reservoir 4*a* will automatically be supplied to the compressors 2*a*, 3*a*. But when the oil level in the compressors 2*a*, 3*a* is lower than an oil balance aperture (safe oil level), the oil in the compressors will not flow out through the oil balance aperture. In summary, the excess oil in the compressors will flow into the oil reservoir 4*a* due to the principle of connected vessels. Conversely, the oil in the oil reservoir 4*a* will automatically supply oil to the compressors when the oil level in the compressors is too low.

The oil balance pipe 20 is connected to other units through a fourth valve 8*a* to provide a lubricating oil connection between the different units 1*a*, 1*b*.

A section of pipe disposed between the bottom of the oil reservoir 4*a* and the fourth valve 8*a* protrudes into the oil reservoir 4*a* to a suitable protruding height. The protruding height depends on the size of the oil reservoir 4*a* and the size of the compressors. The objective of setting the protruding height is that enough oil remain in the compressors 2*a*, 3*a* to prevent the oil level in the compressors 2*a*, 3*a* of unit 1*a* from being too low when the oil in the oil reservoir 4*a* is forced into another unit 1*b*. The setting the protruding height improves the operational reliability of the compressors.

Figure 2:
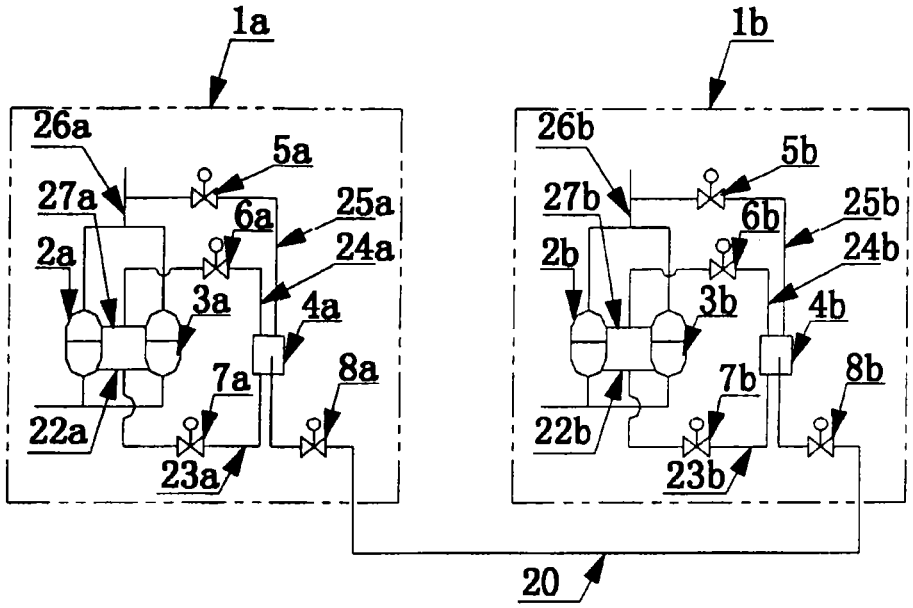
FIG. 2 is a simplified schematic view illustrating the first embodiment of FIG. 1.

For illustration, FIG. 2 only shows the combination parts relating to the oil balance. The reference characters of each component of the compressor unit 1*a* corresponds with that of the compressor unit 1*b*, and the suffixes are a and b, respectively. The oil balance operation will be described in the following according to FIG. 2.

First Method to Achieve the Oil Balance.

When the oil balance is operated, all the valves in the units should be operated as shown in table 1:

TABLE 1

| | Unit 1a | | | | | Unit 1b | | | | |
|---|---|---|---|---|---|---|---|---|---|---|
| | Compressor | 1# valve 5a | 2# valve 6a | 3# valve 7a | 4# valve 8a | Compressor | 1# valve 5b | 2# valve 6b | 3# valve 7b | 4# valve 8b |
| Normal Working Condition | Normal Running | closed | open | open | closed | Normal Running | closed | open | open | closed |
| Operation 1: unit 1a supplies oil. unit 1b receives oil | | open | closed | closed | open | | closed | open | closed | open |
| Operation 2: unit 1b supplies oil. unit 1a receives oil | | closed | open | closed | open | | open | closed | closed | open |

It must be noted that at least one of the compressor units involved in the oil balance operation between the compressor units is operating and all the compressors that are operating are normally regulated by a controller. The Regulation of the compressors by the controller has no influence on the oil balance operation between the units, and vice versa.

In a normal operation, the second valve 6*a* and the third valve 7*a* are opened, while the first valve 5*a* and the fourth valve 8*a* are closed. The pressure balance between the oil reservoir 4*a* and the compressors 2*a*, 3*a* can be achieved by the connection of the gas balance pipe 24*a* and the gas balance pipe 27*a* of the compressors 2*a*, 3*a*. Due to the principle of connected vessels, the connection of the oil balance pipe 23*a* and the oil balance pipe 22*a* of the compressors 2*a*, 3*a* can achieve not only the balance between the two compressors 2*a*, 3*a*, but also the balance between the compressors and the oil reservoir 4*a*. When the oil level in the compressors 2*a*, 3*a* is too high, the oil in the compressors will flow into the oil reservoir 4*a* through the oil balance pipe 23*a*. When the oil level in the compressors 2*a*, 3*a* is too low, the oil in the oil reservoir 4*a* will automatically be supplied to the compressors. Furthermore, the oil in the compressors will not flow into the oil reservoir 4*a* through the oil balance opening of the compressors once the oil level in the compressors 2*a*, 3*a* is lower than the oil balance opening (safe oil level).

Figure 3:
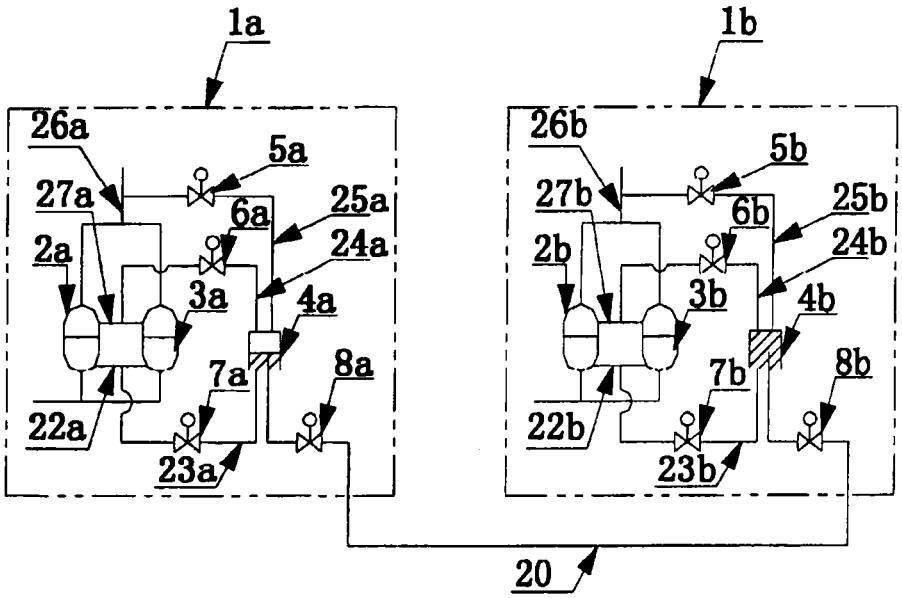
FIG. 3 is a schematic view illustrating an oil balance operation between different units.

As shown in FIG. 3, during a first operation, the unit 1*a* supplies oil to other unit 1*b* firstly. The first valve 5*a* of unit 1*a* is open to apply the exhaust pressure onto the oil reservoir 4*a*. At the same time the second valve 6*a* and the third valve 7*a* are closed not only to prevent a gas flow short-circuit, but also to prevent the oil flowing back into the compressors 2*a*, 3*a* through the third valve 7*a*. In such a way, the excess oil (the oil above the protruding height) in the unit 1*a* will flow into the unit 1*b* through the fourth valve 8*a*. Simultaneously, the fourth valve 8*b* of the unit 1*b* opens and the excess oil from the unit 1*a* can flow into an oil reservoir 4*b* of the unit 1*b*. A second valve 6*b* of the unit 1*b* will open to exhaust the gas in the oil reservoir 4*b* to prevent the pressure rising in the oil reservoir 4*b* which would block the lubricating oil from flowing into the oil reservoir 4*b*. The first valve 5*b* and third valve 7*b* of unit 1*b* are all closed.

The oil reservoir according to the present invention is designed specially and the section of pipe disposed between the bottom of the oil reservoir 4*a* and the fourth valve 8*a* is inserted into the oil reservoir 4*a* to the protruding height. During the first operation, when the oil level in the oil reservoir 4*a* is higher than the protruding height, it could be considered that the oil level in the unit 1*a* is higher than a design value. Due to the effect of the compressor discharge pressure, the excess oil will be transferred to the oil reservoir 4*b* of the other unit 1*b*. When the oil level in the oil reservoir 4*a* is lower than the protruding height, it could be considered that the oil level in the unit 1*a* is lower than the design valve and no oil flows into other units. Because the oil in both compressor units is sufficient to satisfy the lubrication requirement of both units, the oil reservoir 4*b* of the unit 1*b* will not be short of oil even at the end of the first operation. The unit 1*a* will be waiting for a second operation in which other compressor units will supply oil to unit 1*a*.

Figure 4:
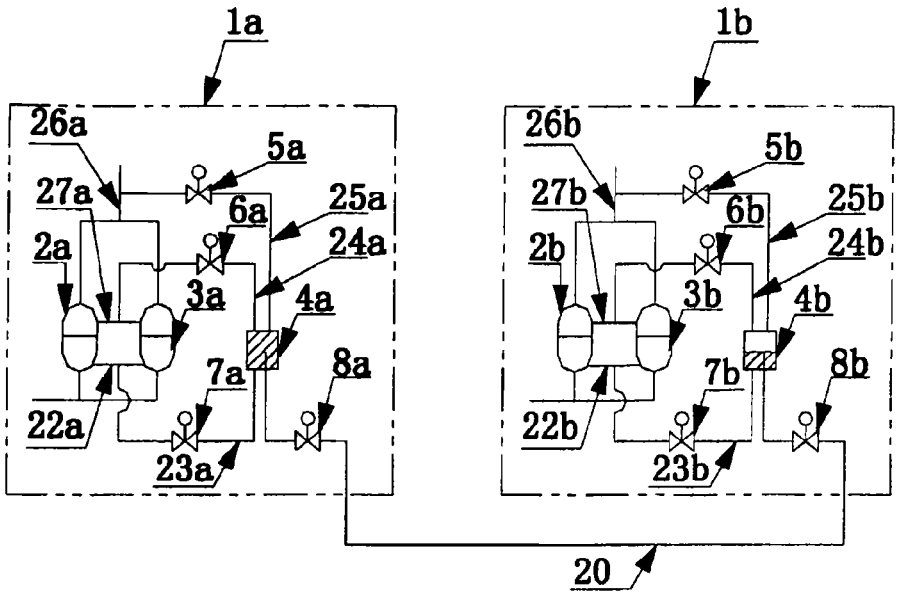
FIG. 4 is a schematic view illustrating the oil balance operation between different units.

Referring to FIG. 4, during the second operation, the first valve 5*b* of the unit 1*b* opens to apply the discharge pressure of the compressors to the oil reservoir 4*b*. Meanwhile, the second valve 6*b* and the third valve 7*b* are closed not only to prevent gas flow short-circuit, but also to prevent the oil from flowing back into the compressors 2*b*, 3*b* through the third valve 7*b*. In such a way, the lubricating oil in the unit 1*b* will flow into the unit 1*a* through the open fourth valve 8*b*. Simultaneously, the fourth valve 8*a* of the unit 1*a* opens and allows the oil from the unit 1*b* to flow into the oil reservoir 4*a* of the unit 1*a*. The second valve 6*a* of the unit 1*a* then opens to exhaust the gas in the oil reservoir 4*a*, to prevent excess pressure in the oil reservoir 4*a* from causing the lubricating oil not to flow into the oil reservoir 4*a* from unit 1*b*. The first valve 5*a* and the third valve 7*a* are closed. Therefore, the oil reservoir 4*a* of the unit 1*a* originally depleted of oil receives supplemental oil. Meanwhile, the oil reservoir 4*b* of the unit 1*b* retains sufficient lubricating oil for the operation of unit 1*b*, and the excess oil is discharged.

If the system includes more units, e.g., 1*c*, 1*d* (not shown), the oil supply from the unit 1*b* to the units 1*c* will be processed once the oil supply from the unit 1*a* to unit 1*b* is finished. Next the supply from the unit 1*c* to unit 1*d* will be processed once the supply from the unit 1*b* to unit 1*c* is finished. Similarly, the oil supply operation will be processed one by one until the oil reaches the last unit. Next the oil will flow back from the last unit to other units in reverse order until the oil reaches the first unit. For example, in a system comprising four units, the sequence of the loop is a→b→c→d, and next is d→c→b→a in reverse order. The above sequence is not unique and the main feature is that the lubricating oil in the system will pass through each unit in the forward and reverse order to leave a certain volume of oil in each oil reservoir of each unit to ensure the oil balance in the system.

When the balance operation is done between the units 1*a* and 1*b*, the units are then in normal operation. The second valve 6*a*, 6*b* and the third valve 7*a*, 7*b* are all opened. The first valve 5*a*, 5*b* and the fourth valve 8*a*, 8*b* are all closed. The opened and closed valves cause the oil level to balance between the oil reservoir and the compressors. The oil flows into the oil reservoir from the compressors when the oil in the compressors is excessive. And the oil reservoir provides surplus oil to the compressor units when the oil in the compressors is too little.

Second Method to Achieve the Oil Balance.

When the oil balance is sought, all the valves in the units should be operated as shown in table 2:

In such a way, the excess oil (the oil above the protruding height) in the unit 1*b* will flow into the unit 1*a* through the open fourth valve 8*b*. Meanwhile, the fourth valve 8*a* and the third valve 7*a* are opened and the first valve 5*a* and the second valve 6*a* are closed. The excess oil from the unit 1*b* will pass through the oil reservoir 4*a* and flow into the compressors 2*a*, 3*a* under the force of the discharge pressure.

TABLE 2

| | Unit 1a | | | | | Unit 1b | | | | |
|---|---|---|---|---|---|---|---|---|---|---|
| | Compressor | 1# valve 5a | 2# valve 6a | 3# valve 7a | 4# valve 8a | Compressor | 1# valve 5b | 2# valve 6b | 3# valve 7b | 4# valve 8b |
| Normal Working Condition | Normal Running | closed | open | open | closed | Normal Running | closed | open | open | closed |
| Operation 1: unit 1a supplies oil. unit 1b receives oil | | open | closed | closed | open | | closed | closed | open | open |
| Operation 2: unit 1b supplies oil. unit 1a receives oil | | closed | closed | open | open | | open | closed | closed | open |

During normal operation, the second valve 6*a* and the third valve 7*a* are open and the first valve 5*a* and the fourth valve 8*a* are closed. The pressure balance between the oil reservoir and the compressors is achieved by the connection of the gas balance pipe 24*a* and the gas balance pipe of the compressors. Based on the principle of connected vessels, the connection of the oil balance pipe 23*a* and the oil balance pipe 22*a* of the compressors can achieve not only the balance between the compressors 2*a*, 3*a*, but also the balance between the compressors and the oil reservoir 4*a*. The oil in the compressors will flow into the oil reservoir 4*a* through the oil balance pipe 23*a* if the oil level in the compressors 2*a*, 3*a* is too high. The oil in the oil reservoir 4*a* will automatically provide oil to the compressors if the oil level in the compressors 2*a*, 3*a* is too low. Furthermore, the oil in the compressors will not flow into the oil reservoir through the compressor oil balance openings if the oil level in the compressors 2*a*, 3*a* is lower than the oil balance aperture (safe oil level).

In a first operation, the unit 1*a* supplies oil to other units firstly. The first valve 5*a* is open to apply the discharge pressure of the compressors onto the oil reservoir 4*a*. Simultaneously, the second valve 6*a* and the third valve 7*a* are closed to prevent not only a gas flow short-circuit, but also to prevent the oil from flowing back into the compressors 2*a*, 3*a* through the third valve 7*a*. In such a way, the excess oil (the oil above the protruding height) in the unit 1*a* will flow into the unit 1*b* through the open fourth valve 8*a*. Meanwhile, the fourth valve 8*b* and the third valve 7*b* are open, and the first valve 5*b* and second valve 6*b* are closed. The excess oil from the unit 1*a* will pass through the oil reservoir 4*b* and flow into the compressors 2*b*, 3*b* under the force of the compressor discharge pressure.

After a period of time of normal operation of the unit 1*a* and unit 1*b*, the second valve 6*a*, 6*b* and the third valve 7*a*, 7*b* are opened and the first valve 5*a*, 5*b* and the fourth valve 8*a*, 8*b* are closed. The opened and closed valves allow the oil balance between the oil reservoir and the compressors.

The second operation is executed after a period of time of normal operation. The unit 1*b* supplies oil to unit 1*a* and the first valve 5*b* is opened to apply the discharge pressure of the compressors onto the oil reservoir 4*b*. Simultaneously, the second valve 6*b* and the third valve 7*b* are closed to prevent not only the gas flow short-circuit, but also the oil flowing back into the compressors 2*b*, 3*b* through the third valve 7*b*.

Because the oil in the combined units is sufficient to satisfy the lubrication of the combined units, the oil reservoir 4*b* of the unit 1*b* will not be short of oil even after the first operation. The oil reservoir 4*a* and the compressors of the unit 1*a* originally depleted of oil, receive supplemental oil after the second operation. Meanwhile, the oil reservoir 4*b* of compressor unit 1*b* retains enough lubricating oil for its use and the excess oil is discharged.

If the system includes more units 1*c*, 1*d*, the oil supply from the unit 1*b* to the units 1*c* will be processed once the oil supply from the unit 1*a* to unit 1*b* is finished. Next the supply from the unit 1*c* to unit 1*d* will be processed once the supply from the unit 1*b* to unit 1*c* is finished. Similarly, the oil supply operation will be processed one by one until the oil reaches the last unit. Next the oil would flow back from the last unit to other units in a reverse order until the oil reaches the first unit. For an example, in a system comprising four units, the sequence of the loop is a→b→c→d, and next is d→c→b→a in a reverse order. The above sequence is not unique and the main feature is that the lubricating oil in the system will pass through each unit in the forward and reverse order to leave a certain volume of oil in each oil reservoir of each unit to ensure oil balance in the system.

The unit receiving the oil will be in normal operation for a period of time after oil receiving is done to balance the oil levels of the compressors and the oil reservoir. Then another oil balancing operation will be executed.

Figure 5:
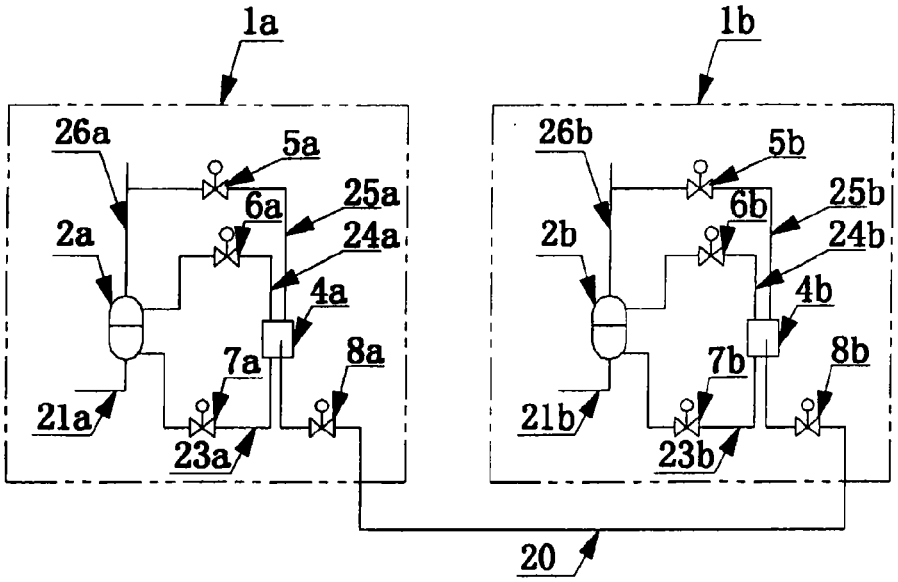
FIG. 5 is a schematic view illustrating the oil balance operation between different units including only one compressor respectively.

Referring to FIG. 5, if each unit comprises only one compressor (the two compressors 2*a*, 3*a* of unit 1*a* are combined into one compressor for example), the gas balance pipe between the two compressors described above is removed. So the gas balance pipe 24*a* of the oil reservoir is connected to a gas balance opening of the compressor and oil balance pipe 23*a* of the oil reservoir is connected to an oil balance opening of the compressor. In such a way, both the gas balance and the oil balance between the single compressor and the oil reservoir can be achieved. The actual implementation method is the same as that of the multi-compressors system.

Figure 6:
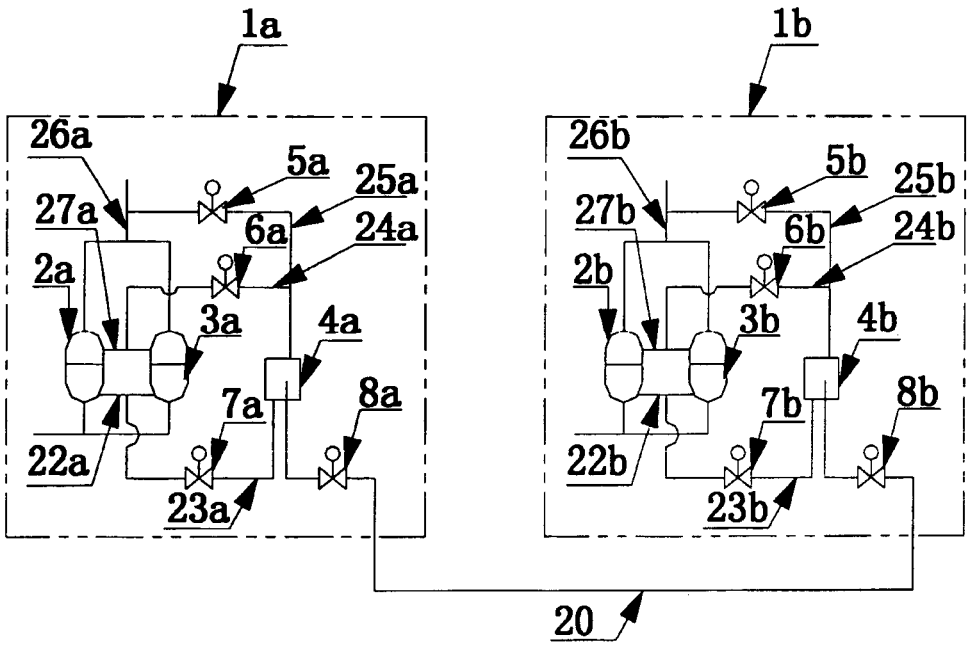
FIG. 6 is a schematic view illustrating an oil reservoir installed in a simplified way.

The gas balance pipe 24*a* and an exhaust connecting pipe 25*a* of the oil reservoir 4*a* can be separately connected to the oil reservoir 4*a* and also could be combined together firstly and then connected to the oil reservoir 4*a* as shown in FIG. 6.

The present invention is not only suitable for multi-air conditioner systems, but is also suitable for chiller (heat pump) systems comprising a plurality of parallel-connected compressors, multi-connected air conditioners; water-cooled or air-cooled duct type air conditioners; scroll-type water-cooled or air-cooled chillers or heat pumps, water-cooled package units and so on. The invention is suitable when the air conditioning systems comprise two or more than two parallel connected compressor units and the units are connected in parallel by the pipes on the high-pressure side and low-pressure side to construct a closed refrigerant loop. Furthermore, the oil lines of the compressor units are connected together by the oil balance device according to the present invention which achieves oil balance between the units.

Figure 7:
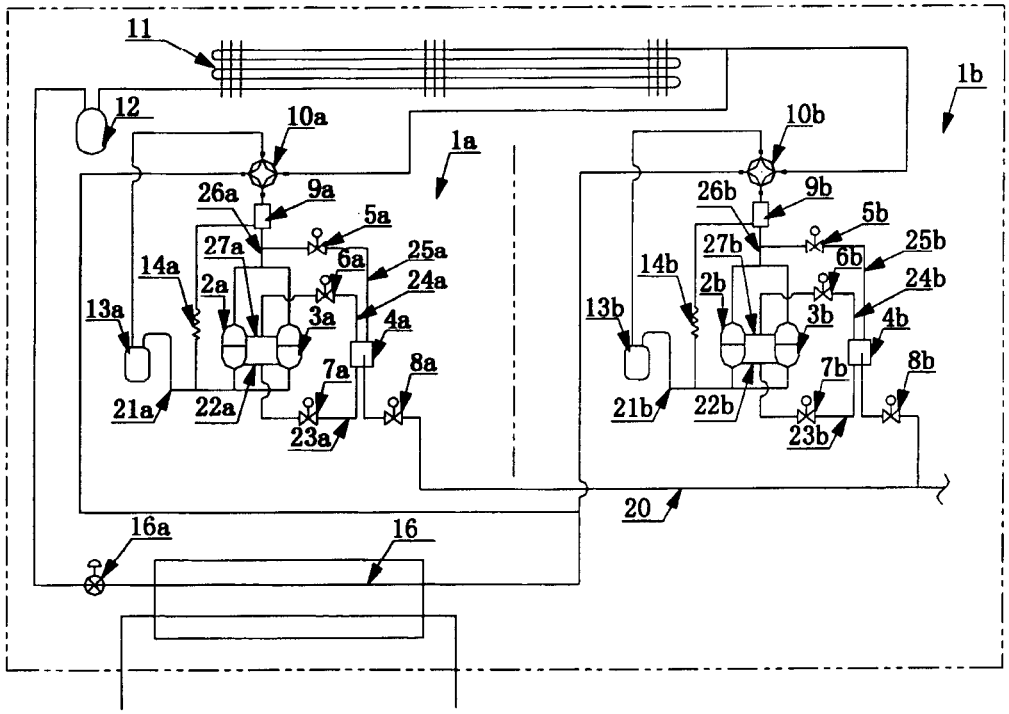
FIG. 7 is a schematic view illustrating the configuration of air-cooled scroll chiller (heat pump) units according to a second embodiment of the present invention.

FIG. 7 illustrates a second embodiment of the present invention. The concept of the second embodiment according to the present invention is approximately similar to the concept of multi-air conditioners. For the convenience of description, the compressor unit on the left is referred to as 1*a* and the compressor unit on the right is referred to as 1*b*. The connection of pipes and the corresponding definitions are essentially consistent in the unit 1*a* and unit 1*b* to previous descriptions so that it is unnecessary to go into details. The difference is that because the whole system is integrated into one shell or housing the heat exchanger of the unit 1*a* and the heat exchanger of the unit 1*b* are combined into a single heat exchanger 11. The two units 1*a*, 1*b* share a common liquid reservoir 12 (the liquid reservoir 12 may be omitted in some instances based on the design of the system) in such a way that the outlets of the four-way valves of the unit 1*a* and the unit 1*b* are first combined and then connected to the heat exchanger 11. The system also comprises an indoor heat exchanger 16 and an expansion valve 16*a*. The heat exchanger 11 can be set in an outdoor system to exchange heat with the refrigeration system by a second medium, for example, air-cooled chiller (heat pump) units. The heat exchanger 11 also could be such an exchanger in which water exchanges heat with the refrigerant directly and such a heat exchanger could be disposed in one housing with a compressor system, for example, the water-cooled packaged air-conditioning units. The heat exchanger may also be disposed on an indoor side, for example, air-cooled duct type heat pumps. The air exchanges heat with the heat exchanger and is circulated indoors. The oil balance operation of the embodiment is substantially the same as that of the multi-air conditioner system so it is unnecessary to go into details again.

Figure 8:
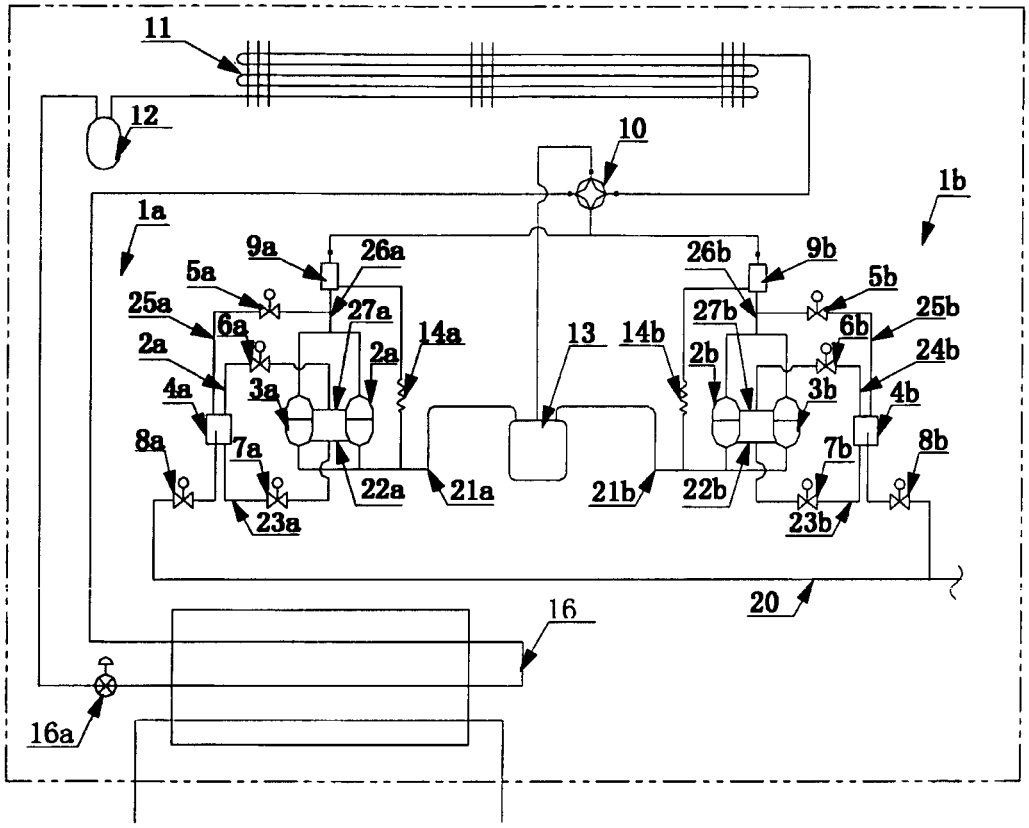
FIG. 8 is a schematic view illustrating the configuration of scroll water-cooled package units according to a third embodiment of the present invention.

Referring to FIG. 8, it illustrates a third embodiment of the present invention. The third embodiment makes some small changes to the second embodiment illustrated in FIG. 7 to satisfy the different applications. The unit 1*a* and the unit 1*b* share a common gas-liquid separator 13 and the same four-way valve 10. In this embodiment, the suction pipes of the unit 1*a* and the unit 1*b* converge at the gas-liquid separator 13. The discharge pipe 26*a* of the unit 1*a* and the discharge pipe 26*b* of the unit 1*b* converge firstly and then are connected to the four-way valve 10. The other parts of the embodiment are consistent with the corresponding parts of the second embodiment.

Figure 9:
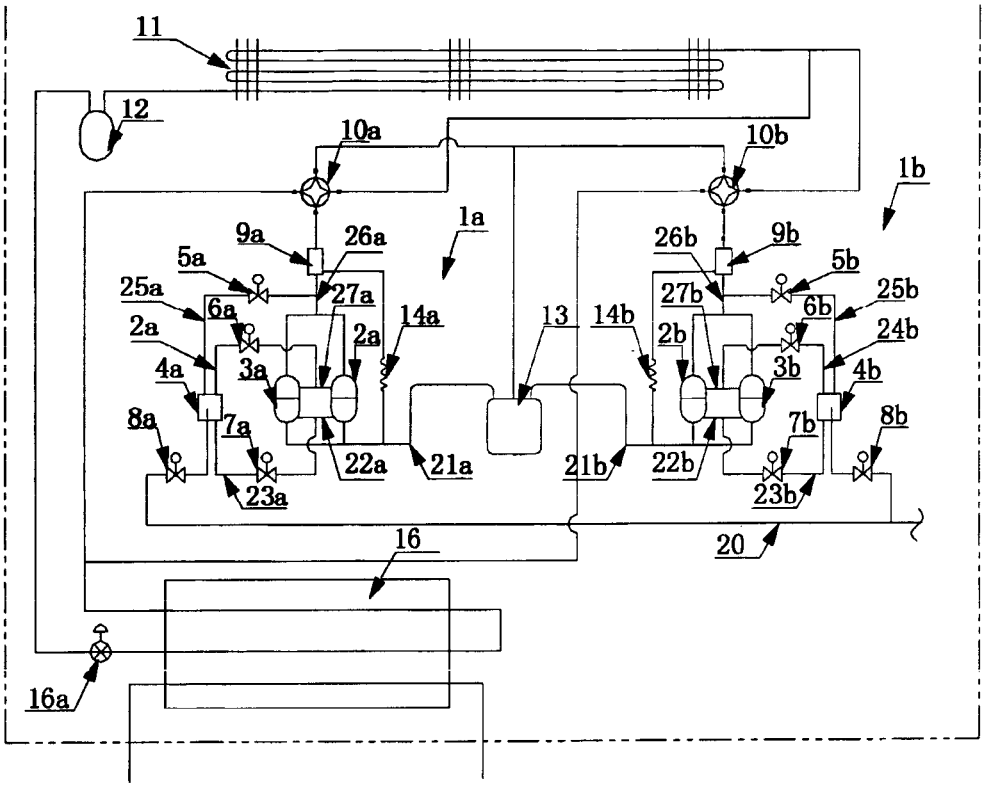
FIG. 9 is a schematic view illustrating the configuration of duct type air conditioning units according to a fourth embodiment of the present invention.

Of course, the discharge pipes of units 1*a*, 1*b* can be connected to their respective four-way valves, similar to those illustrated in FIG. 7. After pushing through the four-way valves, the discharge pipes of units 1*a*, 1*b* are combined and connected to the heat exchanger 11, as illustrated in FIG. 9.

Furthermore, for some special applications, for example, when two parallel connected compressors are disposed in one housing, the control valves 8*a*, 8*b* of the oil balance pipe 20 as illustrated in FIG. 7, 8, 9 can be combined into one control valve.

The first, second, third and fourth valves in the oil balance device of the present invention are controlled to provide flow connection and flow disconnection of the pipes. The valves can be electromagnetic valves controlled by controllers, or also can be electronic expansion valves (EEVs) controlled by controllers. The EEVs could be opened to a certain extent or closed to achieve the connection and the disconnection of the pipes, based on the demand of the oil balance operation. An EEV can be used to control the pressure difference by controlling the extent of the opening of the EEV, especially for the first valve. Of course, the first, second, third and fourth valves also could be other electric or mechanical valves having similar features. In addition, the valves could be disposed somewhere along the length of the pipes or disposed at the junction of the pipes. In an exemplary embodiment the valves along the length of the pipes may be disposed in the interior of the pipes.

The valves described above, especially the valves 6*a*, 6*b*, could be EEVs and the valves could open in normal operation so that the pressure balance between the oil reservoir and the compressors can be achieved. The valves can be closed during the first operation to establish a high pressure in the oil reservoir to force the oil out and the valves can be opened during the second operation to exhaust the gas in the oil reservoir to achieve the transfer of oil.

Figure 10:
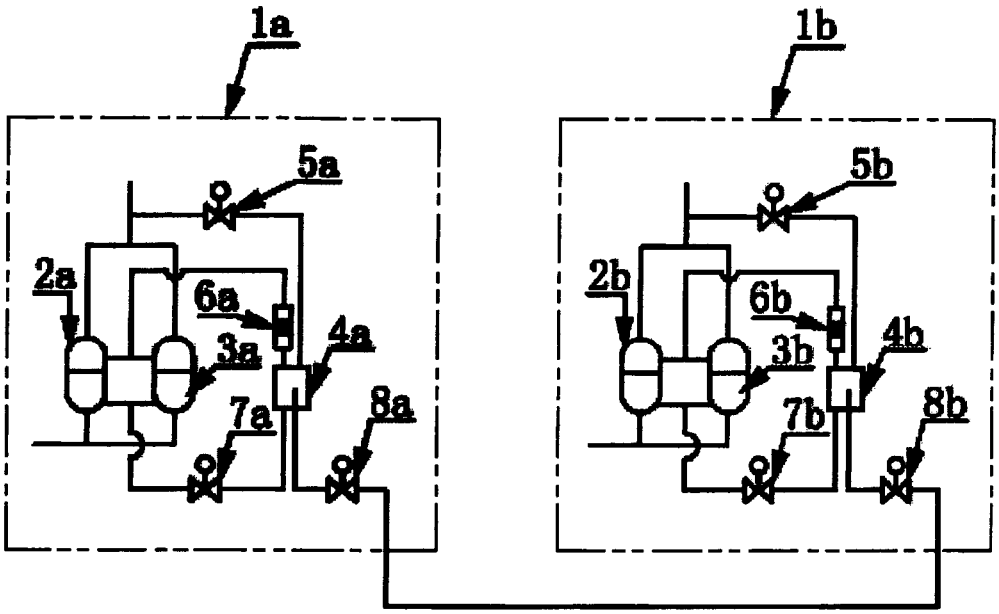
FIG. 10 is a schematic view illustrating the system arrangement of a check valve according to the present invention.
Figure 11:
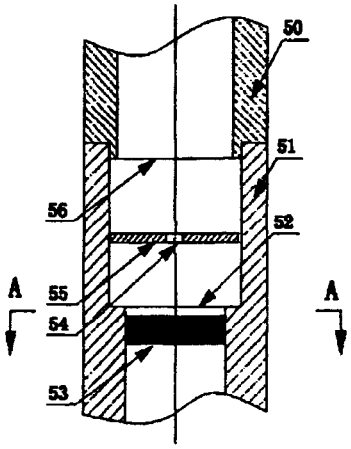
FIG. 11 is a schematic view illustrating the structure of the check valve of FIG. 10.

The present invention also disclosures a check valve designed specially to achieve an improved function of the valves described above. FIG. 10 illustrates the system layout and FIG. 11 illustrates the structure of the check valve.

Figure 12:
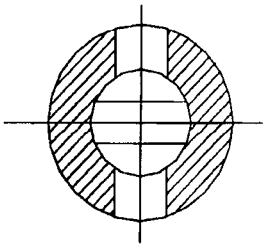
FIG. 12 is a cross section view illustrating the check valve of FIG. 10 along the line A-A.

Generally, a common check valve known to those skilled in the art consists of a valve plate 55, a magnet 53, an upper valve seat 50, a lower valve seat 51 and a shell made of copper tube. To satisfy the requirement of the check valve that flow is possible in one direction and stopped in reverse direction, the lower end surface of the upper valve seat 50 is a contact surface 56. A step is formed in the middle of the lower valve seat 51 and defines a contact surface 52 and a plurality of guiding slots are formed on the circumference of the lower valve seat 51 as shown in FIG. 12.

The difference between the check valve of the present invention and the common check valve is that at least one aperture 54 is formed on the valve plate 55 based on the design parameters and the magnet 53 is embedded in the lower valve seat 51 to ensure the check valve is open when there is no pressure difference or only a slight pressure difference.

In normal operation, the valve 6*a* is forced to open and the valve plate 55 abuts the contacting surface 52 tightly under the magnetic force of the magnet 53 and the gravity. Due to the guiding slots formed on the valve seat 51, the valve is in the open position to achieve the gas balance between the oil reservoir and the compressors. In the first operation, the unit 1*a* supplies oil. The valve 5*a* is open and the high pressure gas flows into the oil reservoir. The valve plate 55 overcomes the magnetic force and the gravitational force and abuts the contacting surface 56 tightly under the pressure difference and thus the valve is closed. The size of the aperture 54 formed on the valve plate 55 depends on the design parameters. When the valve is closed, gas leakage through the aperture 54 will be negligible and the gas leakage would not prevent the valve from closing. The objective of setting the size of the aperture 54 is that high pressure can be relieved when the valve 6*a* changes from the closed status to the open status. For example, the valve 5*a* will close after the oil is discharged and the high pressure of the gas in the oil reservoir will be relieved through the aperture 54. Meanwhile, the valve plate 55 of the valve 6*a* would automatically abut the contacting surface 52 under the magnetic force and gravity and thus the valve 6*a* is opened. In the second operation, the unit 1*a* receives oil. The valves 5*b*, 8*b*, 8*a* are all opened. The check valve 6*a* overcomes the magnetic force and gravity and is closed under a high pressure difference. The aperture 54 formed on the valve plate 55 discharges the gas in the oil reservoir to make sure the oil flows into the oil reservoir smoothly.

According to the present invention, it can be achieved that excess oil is discharged and simultaneously enough oil is retained for the use of the unit. Therefore, the oil balance can be achieved without the use of special oil level measuring instruments, while the oil balancing between the different oil reservoirs is carried out regularly.

The oil balance operation does not require interaction of the compressors to perform on/off operations and each compressor just runs under the normal control of the system. The compressors do not have to repeat on/off operations frequently so that the life of the compressors is not shortened.

Oil balancing between the separate compressor units is driven by the discharge pressure of the compressors so that a certain tolerance differences in installation height among units is permitted and the length of the oil balance pipe is not strictly limited. These advantages make the design more flexible and also requires less time for the oil to balance between the compressors.

The present invention supplies oil to each compressor equally so the operation of the compressor units is more reliable.

The present invention achieves oil balance reliably and effectively under normal operation of the compressor units.

We claim:

1. A compressor unit, comprising:
at least one compressor;
at least one oil balance device, the at least one oil balance device comprising:
an oil reservoir;
a first pipe, wherein one end of the first pipe communicates with the oil reservoir and a second end of the first pipe communicates with the discharge pipe of the compressor;
a first valve for controlling flow in the first pipe;
a second pipe, wherein one end of the second pipe communicates with the oil reservoir and a second end of the second pipe communicates with a gas balance opening of the at least one compressor;
a second valve for controlling flow in the second pipe;
a third pipe, wherein one end of the third pipe communicates with the oil reservoir and a second end of the third pipe communicates with an oil balance opening of the compressor;
a third valve for controlling flow in the third pipe;
a fourth pipe, wherein one end of the fourth pipe communicates with the oil reservoir and a second end of the fourth pipe communicates with a neighboring oil reservoir associated with a neighboring compressor unit; and
a fourth valve for controlling flow in the fourth pipe.

2. The compressor unit according to claim 1, wherein the second pipe communicates with the gas balance opening of the compressor through a gas balance pipe of the at least one compressor.

3. The compressor unit according to claim 1, wherein the third pipe communicates with the oil balance opening of the at least one compressor through an oil balance pipe of the at least one compressor.

4. The compressor unit according to claim 1, wherein a height of a bottom of the oil reservoir is not lower than a height of the oil balance opening of the at least one compressor.

5. The compressor unit according to claim 1, wherein both the first pipe and the second pipe communicate with a top of the oil reservoir, and both the third pipe and the fourth the pipe communicate with a bottom of the oil reservoir.

6. The compressor unit according to claim 1, wherein the first end of the fourth pipe is inserted into an interior of the oil reservoir to a predetermined height.

7. The compressor unit according to claim 1, wherein the first pipe and the second pipe respectively communicate independently with the oil reservoir.

8. The compressor unit according to claim 1, wherein the first pipe and the second pipe comprise a shared pipe in communication with the oil reservoir.

9. The compressor unit according to claim 1, wherein the first valve, the second valve, the third valve and the fourth valve are disposed in an interior of the first pipe, the second pipe, the third pipe and the fourth the pipe, respectively.

10. The compressor unit according to claim 1, wherein the at least one compressor comprises two compressors and wherein the fourth valve is shared by the two compressors when the two compressors are arranged in an interior of one housing.

11. The compressor unit according to claim 1, wherein the second valve comprises a valve plate, a magnet disposed below the valve plate and an aperture formed on the valve plate, wherein a size of the aperture does not prevent the closing of the second valve and a pressure difference between a first side of the valve plate and a second side of the valve plate is relieved when the second valve is switched from the off status to the on status.

12. A method for performing an oil balance operation between a plurality of compressor units, comprising:
providing an oil reservoir for each compressor unit of the plurality of compressor units;
providing a first pipe, a second pipe, a third pipe and a fourth pipe for each compressor unit;
connecting the first pipe to an oil reservoir of a first compressor unit and to a discharge pipe of a first compressor;
connecting the second pipe to the oil reservoir of the first compressor unit and to a gas balance opening of the first compressor;
connecting the third pipe to the oil reservoir of the first compressor unit and to an oil balance opening of the first compressor;
connecting the fourth pipe to the oil reservoir of the first compressor unit and to another oil reservoir belonging to a second compressor unit;
controlling flow in the of first pipe, the second pipe, the third pipe and the fourth pipe by a first valve, a second valve, a third valve and a fourth valve respectively;
closing the first valve and the fourth valve and opening the second valve and the third valve when the compressor units are in a normal operating condition;
opening the first valve and the fourth valve and closing the second valve and the third valve when the compressor units are supplying oil to the oil reservoir;
opening the second valve and the fourth valve and closing the first valve and the third valve, or opening the third valve and the fourth valve and closing the first valve and the second valve, when the compressor units are receiving oil from the oil reservoir.

13. The method according to claim 12, wherein the compressor unit operates in the normal operating condition for a period of time before starting to supply oil to the reservoir.

14. The method according to claim 12, wherein the compressor unit operates in the normal operating condition for a period of time after receiving the oil from the reservoir.

15. The method according to claim 12, wherein the two compressor units which supply oil and receiving the oil, respectively, are adjacent compressor units.

16. The method according to claim 12, wherein the adjacent compressor units supply oil and receive the oil, respectively.

17. The method according to claim 12, wherein the supplying and the receiving of the oil are performed in order, one by one, by the compressor units in a first cycle and in reverse order in a following cycle.

18. The method according to claim 12, wherein the second pipe communicates with the gas balance opening of the compressor through a gas balance pipe of the compressor.

19. The method according to claim 12, wherein the third pipe communicates with the oil balance opening of the compressor through an oil balance pipe of the compressor.

20. The method according to claim 12, wherein the height of a bottom of the oil reservoir is not lower than the height of the oil balance opening of the compressor.

21. The method according to claim 12, wherein the first pipe and the second pipe communicate with a top of the oil reservoir, and the third pipe and the fourth pipe communicate with a bottom of the oil reservoir.

22. The method according to claim 12, wherein the end of the fourth pipe communicating with the bottom of the oil reservoir is inserted into the interior of the oil reservoir to a predetermined height.

23. The method according to claim 12, wherein the first pipe and the second pipe, respectively, communicate independently with the oil reservoir.

24. The method according to claim 12, wherein the first pipe and the second pipe comprise a shared pipe in communication with the oil reservoir.

25. The method according to claim 12, wherein the first valve, the second valve, the third valve and the fourth valve are disposed in the first pipe, the second pipe, the third pipe and the fourth the pipe respectively.

26. The method according to claim 12, wherein the fourth valve is shared by two adjacent compressor units when the two compressor units are arranged in the interior of one shell.

* * * * *